US005431277A

United States Patent [19]

Focke

[11] Patent Number: 5,431,277

[45] Date of Patent: Jul. 11, 1995

[54] BUNDLE PACK FOR CIGARETTE PACKS WITH ELEVATED BOTTOM WALL

[75] Inventor: Heinz Focke, Verden, Germany

[73] Assignee: Focke & Co. (GmbH & Co.), Verden, Germany

[21] Appl. No.: 231,837

[22] Filed: Apr. 25, 1994

[30] Foreign Application Priority Data

Apr. 26, 1993 [DE] Germany ..... 43 13 644.3

[51] Int. Cl.[6] ..... B65D 85/10; B65D 5/42

[52] U.S. Cl. ..... 206/273; 206/271; 229/104

[58] Field of Search ..... 206/248, 271, 273, 256, 206/264; 229/104

[56] References Cited

U.S. PATENT DOCUMENTS

| | | | |
|---|---|---|---|
| 1,217,029 | 2/1917 | Long | 229/104 |
| 1,876,200 | 9/1932 | Brown et al. | 229/104 |
| 1,898,646 | 2/1933 | Taylor | 229/104 X |
| 1,912,736 | 6/1933 | Sutherland | 229/104 |
| 1,923,928 | 8/1933 | Jacobs | 229/104 X |
| 2,005,924 | 6/1935 | Wilson | 229/104 X |
| 2,536,990 | 1/1951 | Williamson | 229/104 X |
| 2,703,645 | 3/1955 | Scrimshaw . | |
| 2,783,929 | 3/1957 | Delaney | 206/273 X |
| 2,979,250 | 4/1961 | Hobbs | 229/104 |
| 3,752,308 | 8/1973 | Begemann | 206/273 X |
| 4,738,359 | 4/1988 | Phillips, Jr. | 206/256 |

FOREIGN PATENT DOCUMENTS

| | | |
|---|---|---|
| 344466 | 4/1989 | European Pat. Off. . |
| 346025 | 12/1989 | European Pat. Off. . |
| 8020237 | 10/1980 | Germany . |
| 8803726 | 8/1989 | Germany . |
| 4125119 | 2/1993 | Germany . |

*Primary Examiner*—Bryon P. Gehman
*Attorney, Agent, or Firm*—Sughrue, Mion, Zinn, Macpeak & Seas

[57] ABSTRACT

A bundle pack, made from thin cardboard, for a plurality of cuboid small packs, especially cigarette packs (10). In order to accommodate cigarette packs (10) of small dimension, namely height, in a bundle pack having standard, that is to say larger outer dimensions than the packs, a bottom wall (23) is set back inwards according to the height of the cigarette packs. A free compensating chamber (26) is obtained underneath the bottom wall (23). The downwardly open compensating chamber (26) is surrounded all-round by a double-walled edge.

20 Claims, 5 Drawing Sheets

BUNDLE PACK FOR CIGARETTE PACKS WITH ELEVATED BOTTOM WALL

BACKGROUND OF THE INVENTION

The invention relates to a bundle pack made from thin cardboard for a plurality of cuboid small packs, especially cigarette packs, which completely fill an inner space, namely a pack chamber.

Bundle packs for a plurality of cigarette packs—so-called cigarette sticks—are known in various embodiments. These bundle packs are often made from thin cardboard.

The dimensions of the bundle packs are fixed internationally by the dimensions of the cigarette packs. However, packs, specifically especially hinge-lid packs, having smaller dimensions, namely a smaller height, than the conventional cigarette packs have recently been developed. The smaller packs (hinge-lid packs) serve for receiving shorter cigarettes or cigarette-like stick-shaped smoker's articles. The height of these packs is approximately 60 mm for a minimum height of the conventional cigarette packs of approximately 80 mm. In this new type of pack, the remaining dimensions (width and depth) correspond to the dimensions of the conventional hinge-lid packs.

SUMMARY OF THE INVENTION

The invention is concerned with adapting the bundle pack to the smaller dimensions of the small packs (cigarette packs). The handling of the bundles of small packs is to be possible in the same way as with the bundles of packs of customary size.

The object on which the invention is based is to propose a bundle pack for a plurality of small packs, which has (clearly) larger outer dimensions than corresponds to the volume of the small packs belonging to the bundle pack.

To achieve this object, the bundle pack according to the invention is characterized in that, in the region of a bottom wall or underneath the latter, a downwardly open compensating chamber extending over the entire face of the bottom wall is formed, in such a way that the outer dimensions of the bundle pack are clearly larger than the pack chamber.

The design according to the invention of the bundle pack is intended primarily for cigarette packs of which the dimensions, especially the height, are clearly smaller than the height of conventional cigarette packs. By means of the bundle pack according to the invention, these smaller cigarette packs or a pack group formed from them are wrapped completely and without a gap in the correspondingly dimensioned pack chamber. The bundle pack nevertheless has outer dimensions which correspond to conventional bundle packs for cigarette packs. These standard outer dimensions are desirable for many reasons. The handling, namely transport and storage, is organized in terms of these standard dimensions. Furthermore, frequently used machines for the subsequent affixation of markings, especially revenue stamps, on the small packs are designed for a predetermined standard size of bundle packs. The design of the compensating chamber underneath the bottom wall allows a simple blank shape for producing the bundle pack. Various blank designs are nevertheless suitable for this purpose.

The bundle pack according to the invention is produced from a one-piece blank, with side walls continuous over the entire height and with a bottom wall set back inwards relative to the free or lower edge cants. A pack closure which is easy to handle is formed on the opposite side.

Further particulars of the invention can be taken from the subclaims. Exemplary embodiments of the invention are explained in more detail below by means of drawings. In these

DESCRIPTION OF PREFERRED EMBODIMENTS

Figure 3:
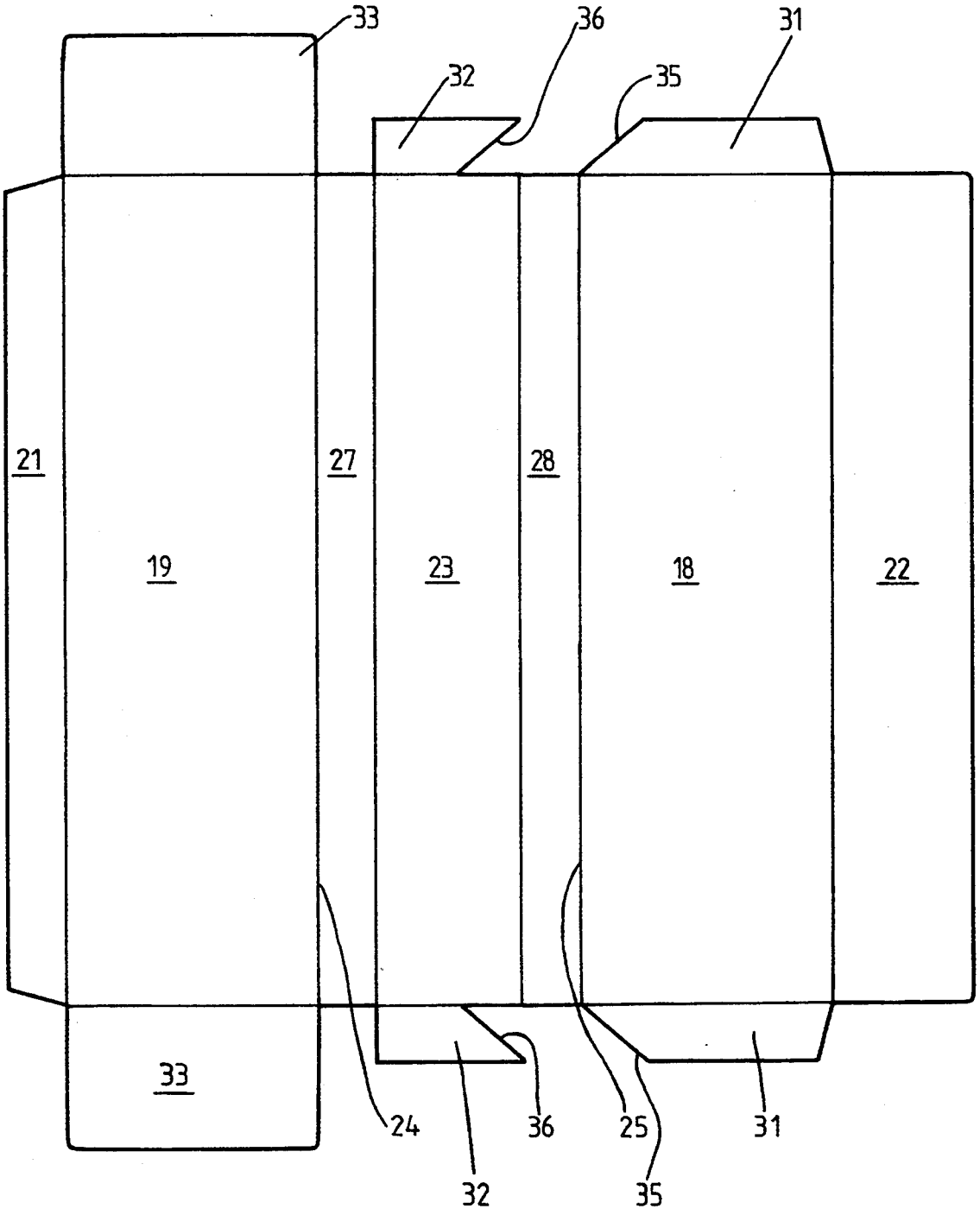
FIG. 3 shows a blank for producing a bundle pack according to FIGS. 1 and 2.
Figure 4:
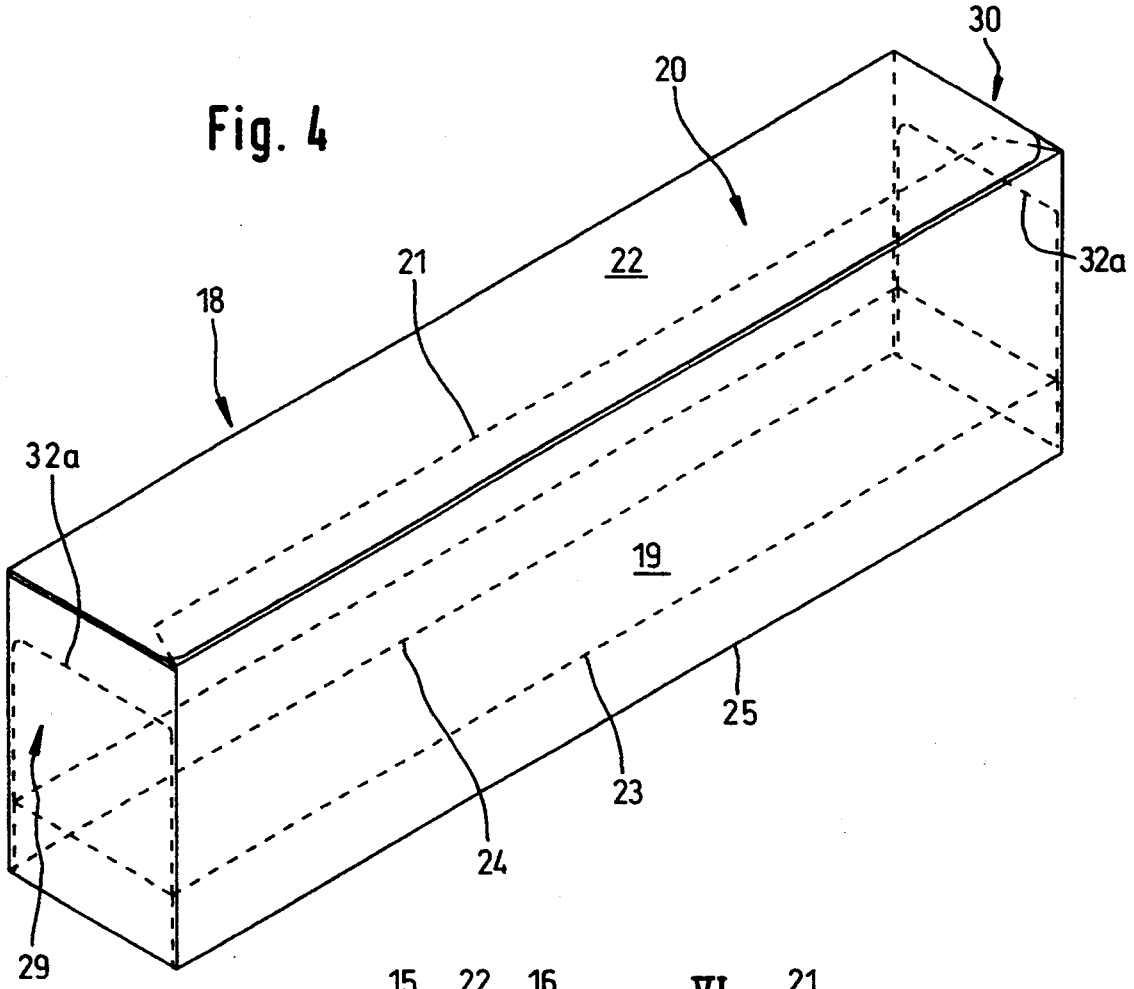
FIG. 4 shows a bundle pack in a perspective representation, similar to the pack according to FIG. 1, but produced from another blank.
Figure 5:
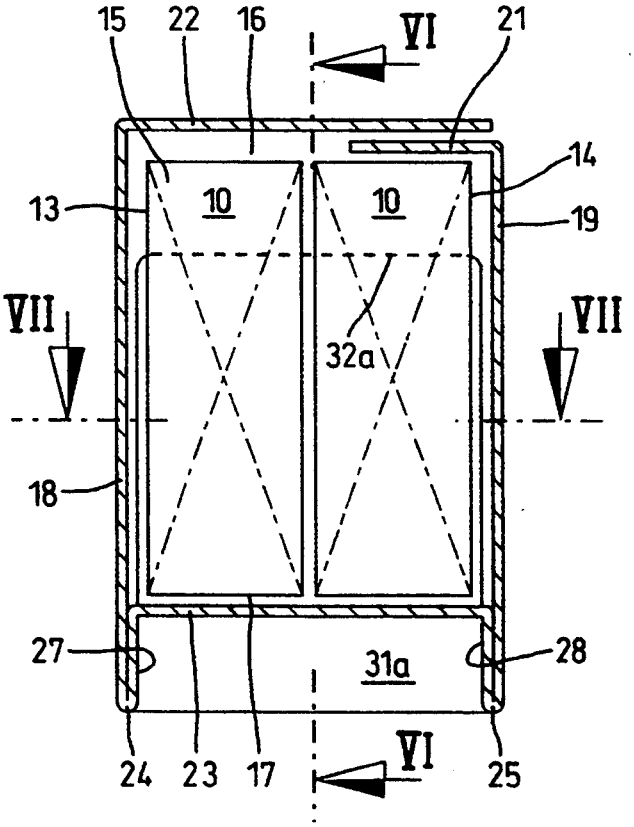
FIG. 5 shows a cross-section through the bundle pack according to FIG. 4 on an enlarged scale, similar to FIG. 2.
Figure 6:
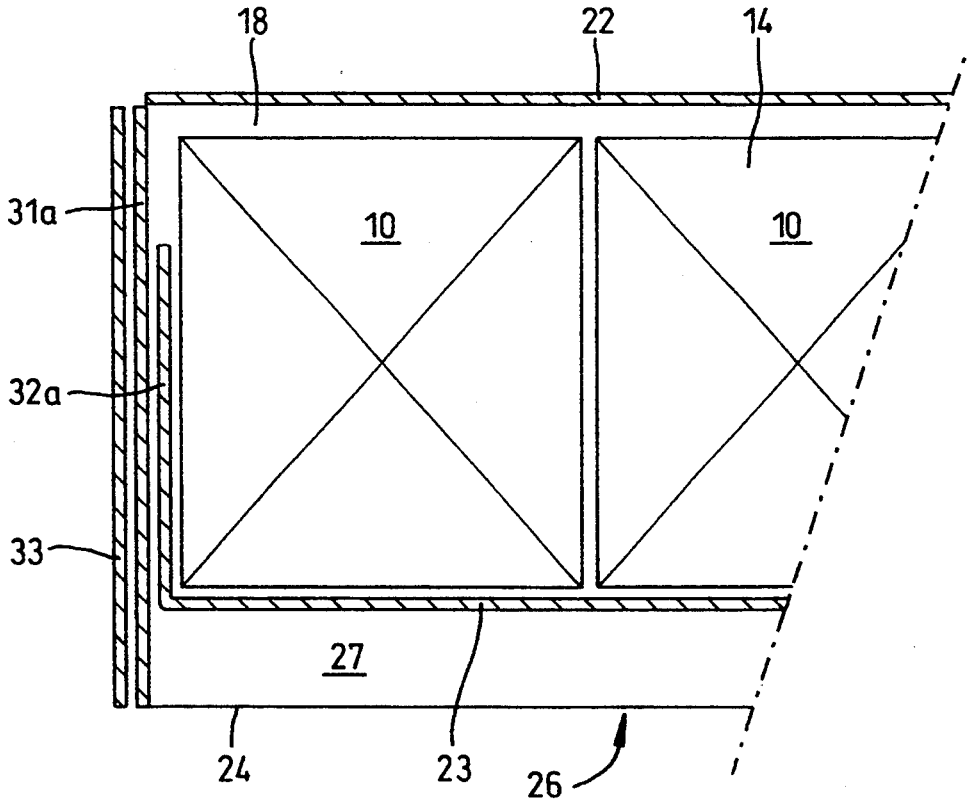
FIG. 6 shows a part section through the bundle pack according to FIG. 5 along the line VI—VI.
Figure 7:
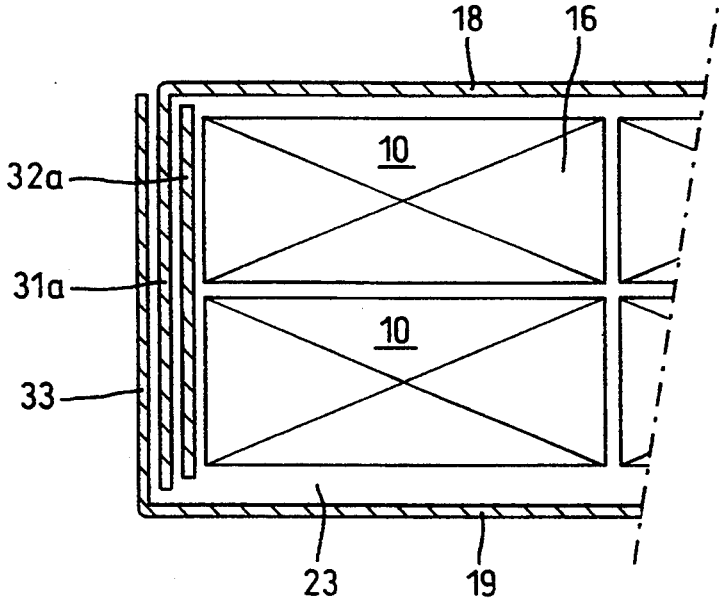
FIG. 7 shows a part section through the bundle pack according to FIG. 5 along the line VII—VII.

The drawings show particulars of a bundle pack which is produced from a one-piece blank according to FIG. 3 made from thin cardboard. The elongate cuboid bundle pack serves for receiving small packs, namely cigarette packs 10. The entire content of the bundle pack is a pack group 11 consisting of ten cigarette packs 10. In the present exemplary embodiment, these are accommodated, oriented in two rows, within an inner space of the bundle pack, namely in a pack chamber 12. The small packs, namely cigarette packs 10, are likewise of cuboid design and preferably hinge-lid packs made from thin cardboard. Each cigarette pack 10 is limited by two large faces located opposite one another, namely a front side 13 and a rear side 14. The cigarette packs 10 of the pack group 11 bear on one another with these faces 13 and 14. Upright narrow side faces 15 are likewise adjacent to one another. At the top and bottom, the cigarette packs 10 form small end faces 16 and bottom faces 17.

Figure 1:
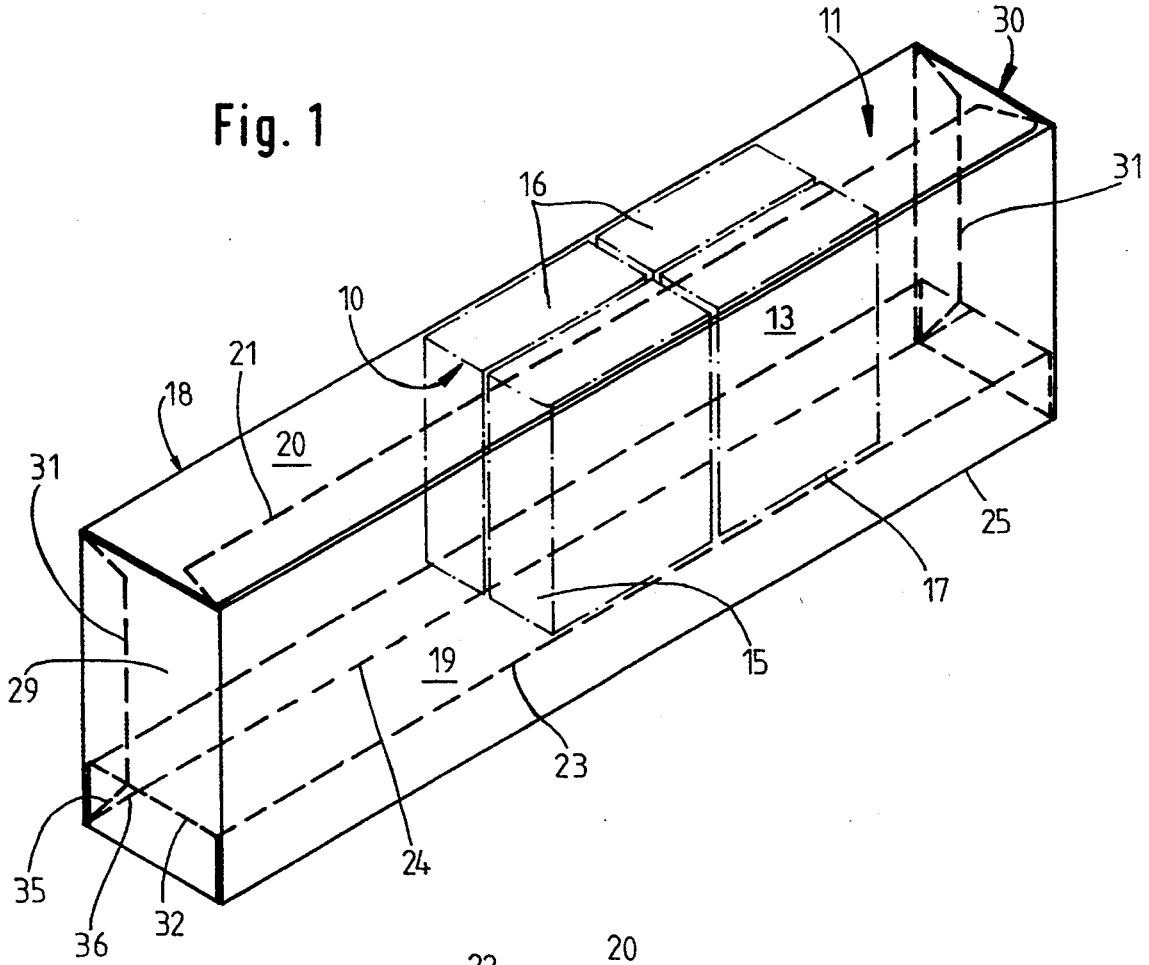
FIG. 1 shows a bundle pack in a perspective representation.
Figure 2:
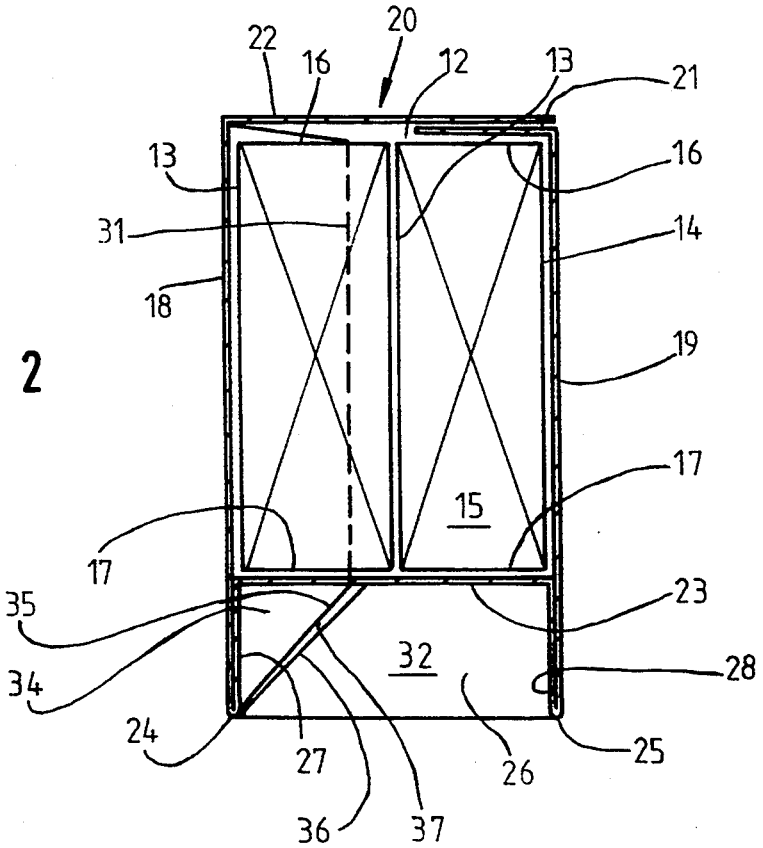
FIG. 2 shows a cross-section through the bundle pack according to FIG. 1 on an enlarged scale.

The bundle pack forms elongate large-face walls, namely a front wall 18 and rear wall 19. These extend over the entire length and over the entire height of the bundle pack. Formed on the top side is a top wall 20 which consists, on the one hand, of an inner edge tab 21 and, on the other hand, of a covering tab 22 extending over the entire width and length of the top wall 20. The edge tab 21 is connected to the free side of the rear wall 19 and the covering tab 22 is connected opposite it to the free edge of the front wall 18 within the blank. The edge tab 21 and covering tab 22 form for the bundle pack a closure which can easily be opened and closed again. This handling is important when markings, especially revenue stamps, are to be subsequently affixed to the cigarette packs 10. In this case, the bundle packs are subsequently opened again by raising the covering tab 22 and edge tab 21. The confronting end faces 16 of the cigarette packs 10 are thereby exposed and can be provided with markings within a special machine. The bundle pack is closed again thereafter, in that the edge tab 21 and the covering tab 22 are brought into the closing position according to FIGS. 1 and 2 and are adhesively bonded to one another or fixed in the closing position in another way.

The capacity of the pack chamber 12 corresponds approximately to the volume of the pack group 11. The pack chamber 12 is limited at the bottom or on the side located opposite the top wall 20 by a bottom wall 23. This is set back inwards relative to the lower contour of the bundle pack or relative to a lower edge cant 24, 25 of the front wall 18, on the one hand, and to the rear wall 19, on the other hand. The distance between the bottom wall 23 and the edge cants 24, 25 corresponds to the smaller length or height of the cigarette packs 10 in relation to conventional standard versions. The total height of the bundle pack or of the front wall 18 and rear wall 19 can, for example, correspond to approximately 80 mm, whilst, in the example shown, the height of the cigarette packs 10 amounts to approximately 60 mm. The bottom wall 23 is therefore set back approximately 20 mm relative to the edge cants 24, 25.

Underneath the bottom wall 23 or on the side remote from the cigarette packs 10, a hollow space, namely a compensating chamber 26, is obtained. In the present exemplary embodiment, this is open at the bottom, namely on the side located opposite the bottom wall 23, and extends over the entire face of the bottom wall 23.

The compensating chamber 26 is limited all-round by an edge or plinth which is of double-walled design. On the longitudinal sides, the edge is formed on the outside by the front wall 18 and rear wall 19. These are connected to the bottom wall 23 via connecting strips 27, 28. The connecting strips 27, 28 extend from the lower edge cants 24, 25 as far as the bottom wall 23. They can be connected to the front wall 18 and rear wall 19 respectively, for example by adhesive bonding.

End walls 29, 30 of the bundle pack are likewise designed in a special way, and at all events extend over the entire height of the bundle pack, including the compensating chamber 26.

The end walls 29, 30 each consist of a plurality of folding tabs. There is, on the one hand, a trapezoidal end tab 31 which is connected to the front wall 18. There is, furthermore, a likewise trapezoidal inner tab 32 in the region of the bottom wall 23, and finally an outer tab 33 on the rear wall 19. The outer tab 33 is dimensioned so that the end walls 29, 30 are overlapped on the outside by this over the entire face, whilst the end tab 31 and inner tab 32 confront the inside of the pack without any mutual overlap and have a smaller face than that of the end walls 29, 30.

In the finished bundle pack, the end tab 31 is connected to the inside of the end wall 29, 30 or at the outer tab 33, for example by adhesive bonding. The end tab 31 extends over the entire height of the bundle pack or of the end wall 29, 30, that is to say also in the region of the compensating chamber 26. Here, a triangular gusset 34 at the end tab 31 forms, together with the outer tab 33, a double-walled limitation of the compensating chamber 26.

The inner tab 32 extends solely in the region of the compensating chamber 26, specifically adjacently to the gusset 34. The inner tab 32 also forms, together with the outer tab 33, a double-walled limitation of the compensating chamber 26 in the region of the end walls 29, 30. The said folding tabs are expediently connected to one another by adhesive bonding.

Equidirectional oblique cants 35 and 36 for limiting the end tab 31 on the one hand, and the inner tab 32, on the other hand, are made with different inclinations, in such a way that the respective oblique cants 35, 36 limit a divergent gap 37 in the finished bundle pack. This geometrical design of the end tabs 31 and inner tabs 32 guarantees that, even with low dimensional tolerances, an overlap of the said folding tabs is avoided. The smaller angle of the oblique cant 36, located on the outside within the blank according to FIG. 3, amounts, for example, to 40°. The angular position of the oblique cant 35 is matched accordingly to this.

Figure 8:
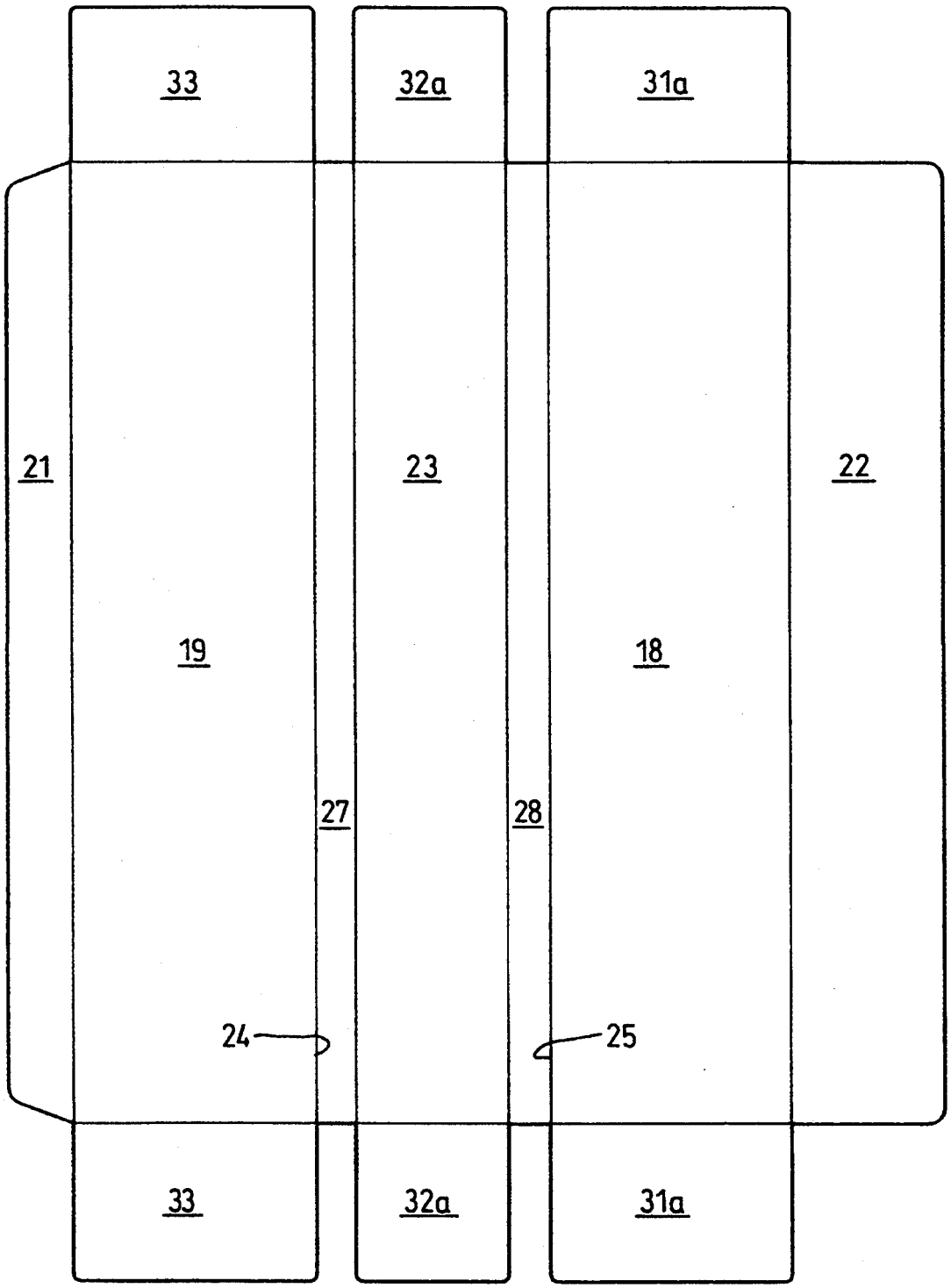
FIG. 8 shows a blank for producing a bundle pack according to FIGS. 4 to 7.

A further exemplary embodiment can be taken from FIGS. 4 to 8. Insofar as the parts have the same design and function as in the exemplary embodiment described previously, the same reference numerals are given. The blank according to FIG. 8 differs from the blank shown in FIG. 3 only in the design of the end tabs and inner tabs. These are designated correspondingly as 31*a* and 32*a*. The end tabs 31*a* are made as large as the outer tabs 33 and extend over the entire face of the end wall 29 and 30 respectively. The inner tabs 32*a* extend in the longitudinal direction of the bottom wall 23 exactly as far as the adjacent end tabs 31a and outer tabs 33. Taken as a whole, the outer contour of the blank according to FIG. 8 is virtually rectangular. It is thereby especially simple to cut out the blank from one full-face sheet. The quantity of waste which occurs is small. The rectangular shape of the tabs 31*a*, 32*a*, 33 allows a simple design of corresponding punching tools.

In the ready-folded bundle pack, the inner tabs 32*a*, directed upwards, bear on the end tabs 31*a* on the inside. The outer tabs 33 bear correspondingly on the outside, that is to say on the other side of the end tabs 31*a*. In the ready-folded bundle pack, the inner tabs 32*a* do not reach fully up to the top wall 20. The end walls 29, 30 are thus made three-ply in the region of the inner tabs 32*a* and two-ply in adjacent regions. In particular, the end walls 29, 30 are only two-ply between the connecting strips 27, 28. The arrangement and orientation of the tabs 31*a*, 32*a* and 33 can be seen especially clearly from FIGS. 6 and 7. The walls limiting the compensating chamber 26 are solely two-ply. Here too, in a similar way to the exemplary embodiment of FIGS. 1 to 3, the tabs 31*a*, 32*a* and 33 are preferably adhesively bonded to one another.

What is claimed is:

1. A bundle pack, made from thin cardboard, for containing a plurality of cuboid small packs which completely fill an upper pack chamber (12) of the bundle pack, wherein:

a) the bundle pack has a front wall (18), a rear wall (19), a top wall (20) and two end walls (29, 30), and is divided into said upper pack chamber (12), for accommodating the small packs, and a lower compensating chamber (26), the bundle pack also having an inner bottom wall (23) which is located between said upper and lower chambers and which extends parallel to the top wall (20);

b) said compensating chamber (26) is downwardly open and extends over an entire face of the bottom wall (23);

c) said compensating chamber (26) is defined by the bottom wall (23), a part of the from wall (18), a part of the rear wall (19), and a part of each of the two end walls (29, 30);

d) the end walls (29, 30) extend over an entire height of the bundle pack and are formed by inner tabs (32*a*), hinged to the bottom wall (23), and by end tabs (31*a*) and outer tabs (33) respectively hinged to the from wall (18) and rear wall (19);

e) the top wall (20) is formed by tabs (21, 22) hinged to the from wall (18) and rear wall (19); and f) the inner tabs (32*a*) are folded upwardly and adjoin the end tabs (31*a*) inside of the upper pack chamber (12).

2. The bundle pack according to claim 1, wherein the inner tabs (32*a*) extend over an entire width of a corresponding one of said end walls (29, 30) such that the front and rear walls (18, 19) adjoin lateral edges of the inner tabs (32*a*).

3. The bundle pack according to claim 1, wherein the end tabs (31*a*) and outer tabs (33) overlap one another at least partly in the compensating chamber (26), beneath the inner tabs (32*a*).

4. The bundle pack according to claim 1, wherein lower edges of the end walls (29, 30) are formed from outer edges of the end tabs (31*a*) and the outer tabs (33).

5. The bundle pack according to claim 1, wherein the end tabs (31*a*) and outer tabs (33) extend over an entire face of a corresponding one of said end walls (29, 30).

6. The bundle pack according to claim 1, wherein the from wall (18) and the rear wall (19) in a region of the lower compensating chamber (26) are each made at least two-ply with an edge cant (24, 25) serving as a lower edge which is formed by folding.

7. The bundle pack according to claim 1, wherein the tabs and walls of multi-ply regions of the bundle pack, which has elongate, cuboid, relatively low and narrow end walls and corresponding bigger outer walls, are bonded to one another.

8. The bundle pack according to claim 1, wherein the front wall (18) and the rear wall (19) extend over the entire height, including the compensating chamber (26), of the bundle pack.

9. The bundle pack according to claim 8, wherein in the bottom wall (23) is connected to a respective lower edge cant (24, 25) of the front wall (18) and rear wall (19) via connecting strips (27, 28), the connecting strips (28, 28) bearing on, and being connected to, a free region of the from wall (18) and rear wall (19).

10. The bundle pack according to claim 1, wherein the two end walls (29, 30) extend over the entire height of the bundle pack, including the compensating chamber (26), via an outer tab (33) of corresponding dimension.

11. The bundle pack according to claim 10, the end walls (29, 30) are made two-ply in part regions, in a region of the compensating chamber (26), by means of the end tabs (31) being connected to a front wall (18) and by inner tabs (32) which are connected to the bottom wall (23) and which extend on the inside of the outer tabs (33).

12. The bundle pack according to claim 10, wherein the two end walls (29, 30) are made two-ply in the region of the compensating chamber (26) by means of the end tabs (31*a*) being connected to the front wall (18) and outer tabs (33) being connected to the rear wall (19), and three-ply in the region of the upper pack chamber (12) by means of inner tabs (32*a*) being connected to the bottom wall (23).

13. A bundle pack, made from thin cardboard, for containing a plurality of cuboid small packs which completely fill an upper pack chamber (12) of the bundle pack, wherein:

a) the bundle pack has a front wall (18), a rear wall (19), a top wall (20) and two end walls (29, 30), and is divided into said upper pack chamber (12), for accommodating the small packs, and a lower compensating chamber (26), the bundle pack also having an inner bottom wall (23) which is located between said upper and lower chambers and which extends parallel to the top wall (20);

b) said compensating chamber (26) is downwardly open and extends over an entire face of the bottom wall (23);

c) said compensating chamber (26) is defined by the bottom wall (23), a part of the front wall (18), a part of the rear wall (19), and a part of each of the two end walls (29, 30);

d) the end walls (29, 30) extend over an entire height of the bundle pack and are formed by inner tabs (32), hinged to the bottom wall (23), and by end tabs (31) and outer tabs (33) respectively hinged to the front wall (18) and rear wall (19);

e) the top wall (20) is formed by tabs (21, 22) hinged to the from wall (18) and rear wall (19); and f) the end tabs (31) and inner tabs (32) have mutually confronting oblique cants (34, 35) which, in the region of the compensating chamber (26), are spaced from one another and form a divergent gap (37) for avoiding an overlap of said end and inner tabs (31, 32).

14. The bundle pack according to claim 13, wherein the inner tabs (32) are folded downwardly and adjoin a lower part of the outer tabs (33) in the region of the compensating chamber (26).

15. The bundle pack according to claim 13, wherein the oblique cants (35, 36) of the inner tabs (32) and the end tabs (31 ) extend in an inclined manner upwards from an outer lower corner of the cuboid bundle pack up to the bottom wall (23) and up to a side of the bundle pack opposite to said lower corner.

16. The bundle pack according to claim 13,wherein the end walls (29, 30) are two-ply and, only in the region of the gap (37), one-ply.

17. The bundle pack according to claim 13, wherein the outer tabs (33) extend over an entire face of the two end walls (29, 30).

18. The bundle pack according to claim 13, wherein the inner tabs (32), except for a region above the oblique cants (36), extend over an entire height and width of the compensating chamber (26).

19. The bundle pack according to claim 13, wherein the front wall (18) and the rear wall (19) extend over the entire height, including the compensating chamber (26), of the bundle pack.

20. The bundle pack according to claim 19, wherein in that the bottom wall (23) is connected to a respective lower edge cant (24, 25) of the front wall (18) and rear wall (19) via connecting strips (27, 28), the connecting strips (28, 28) bearing on, and being connected to, a free region of the front wall (18) and rear wall (19).

* * * * *